US006059599A

United States Patent [19]

Huang

[11] Patent Number: 6,059,599

[45] Date of Patent: May 9, 2000

[54] WIRE HARNESS CABLE ASSEMBLY

[75] Inventor: Wayne Huang, Alhambra, Calif.

[73] Assignee: Hon Hai Precision Ind. Co., Ltd., Taipei Hsien, Taiwan

[21] Appl. No.: 09/176,625

[22] Filed: Oct. 22, 1998

[51] Int. Cl.[7] ..... H01R 13/627

[52] U.S. Cl. ..... 439/362; 439/364

[58] Field of Search ..... 439/362, 364

[56] References Cited

U.S. PATENT DOCUMENTS 5,158,474 10/1992 Frantz ..... 439/362
5,342,216 8/1994 Davis et al. ..... 439/362
5,647,758 7/1997 Ichikawa et al. ..... 439/362
5,921,801 7/1999 O'Sullivan et al. ..... 439/362

*Primary Examiner*—Paula Bradley
*Assistant Examiner*—Katrina Davis

[57] ABSTRACT

A wire harness cable assembly comprises an outer casing defining a receiving space therein. The casing defines a first opening on a side thereof in communication with the receiving space. The casing defines a second opening in an end thereof perpendicular to the first opening. A connector is assembled in the casing and the connector has a mating portion protruding from the first opening for electrical engagement with a complimentary connector. A cable is electrically connected to a connecting end of the connector at one end, and another end of the cable extends through the second opening.

7 Claims, 5 Drawing Sheets

WIRE HARNESS CABLE ASSEMBLY

FIELD OF THE INVENTION

The present invention relates to a cable assembly, and more particularly to a wire harness cable assembly in which an outlet of the cable is orthogonal to a mating portion of a connector thereof thereby reducing the front-to-back dimension of the assembly.

DESCRIPTION OF THE PRIOR ART

As shown in FIG. 1, a conventional wire harness cable assembly 100 comprises a casing 110, and a connector 111 assembled within the casing 110. The connector 111 has a mating portion 111*a* extending beyond a front face 110*a* of the casing 10. A cable 12 enters the casing 110 from a rear end 110*b* and is connected to the connector 111. A pair of locking bolts 113 is assembled to sides of the casing 110 for secure engagement of the assembly 100 to a complimentary I/O port (not shown). The mating portion 111*a* and the cable 112 are aligned since the cable has a certain stiffness and should not be bent it ninety degrees. Accordingly, when the cable assembly 100 is assembled to a rear panel of a computer, a large space is required.

SUMMARY OF THE INVENTION

An objective of this invention is to provide a wire harness cable assembly wherein a mating portion of a connector and an outlet of a cable are arranged at right angles thereby reducing the dimension of the cable assembly.

Another objective of this invention is to provide a cable assembly wherein an adjusting wheel is arranged to facilitate a locking engagement of the assembly to a complimentary I/O port.

In order to facilitate the objectives set forth, a wire harness cable assembly comprises an outer casing defining a receiving space therein. The casing defines a first opening on a side thereof in communication with the receiving space. The casing defines a second opening in an end thereof perpendicular to the first opening. A connector assembled in the casing has a mating portion protruding from the first opening for electrical engagement with a complimentary connector. A cable is electrically connected to a connecting end of the connector at one end, and another end of the cable extends through the second opening.

According to one aspect of the invention, the connector is enclosed by an EMI shield.

According to another aspect of the invention, the cable assembly further comprises a first bolt member extending through a channel defined in an end of the casing. The bolt member has a head located outside of the casing. A threaded portion of the first bolt member extends beyond a front face of the connector. A second bolt member opposite the first bolt member is assembled within the casing. The second bolt member includes an adjusting wheel extending beyond an upper face of the casing. A threaded portion of the second bolt member extends beyond the front face of the connector.

These and additional objects, features, and advantages of the present invention will become apparent after reading the following detailed description of the preferred embodiment of the invention taken in conjunction with the appended drawings.

DETAILED DESCRIPTION OF PREFERRED EMBODIMENT

Figure 1:
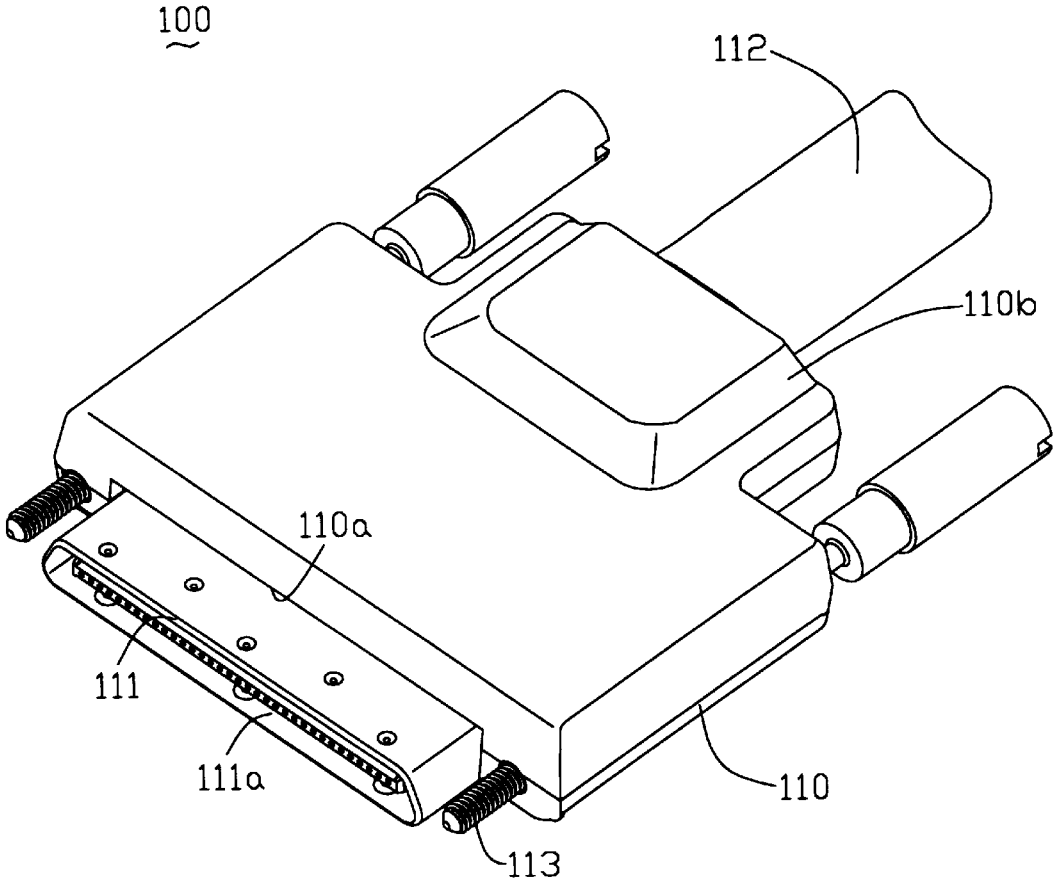
FIG. 1 is a perspective view of conventional cable connector.
Figure 2:
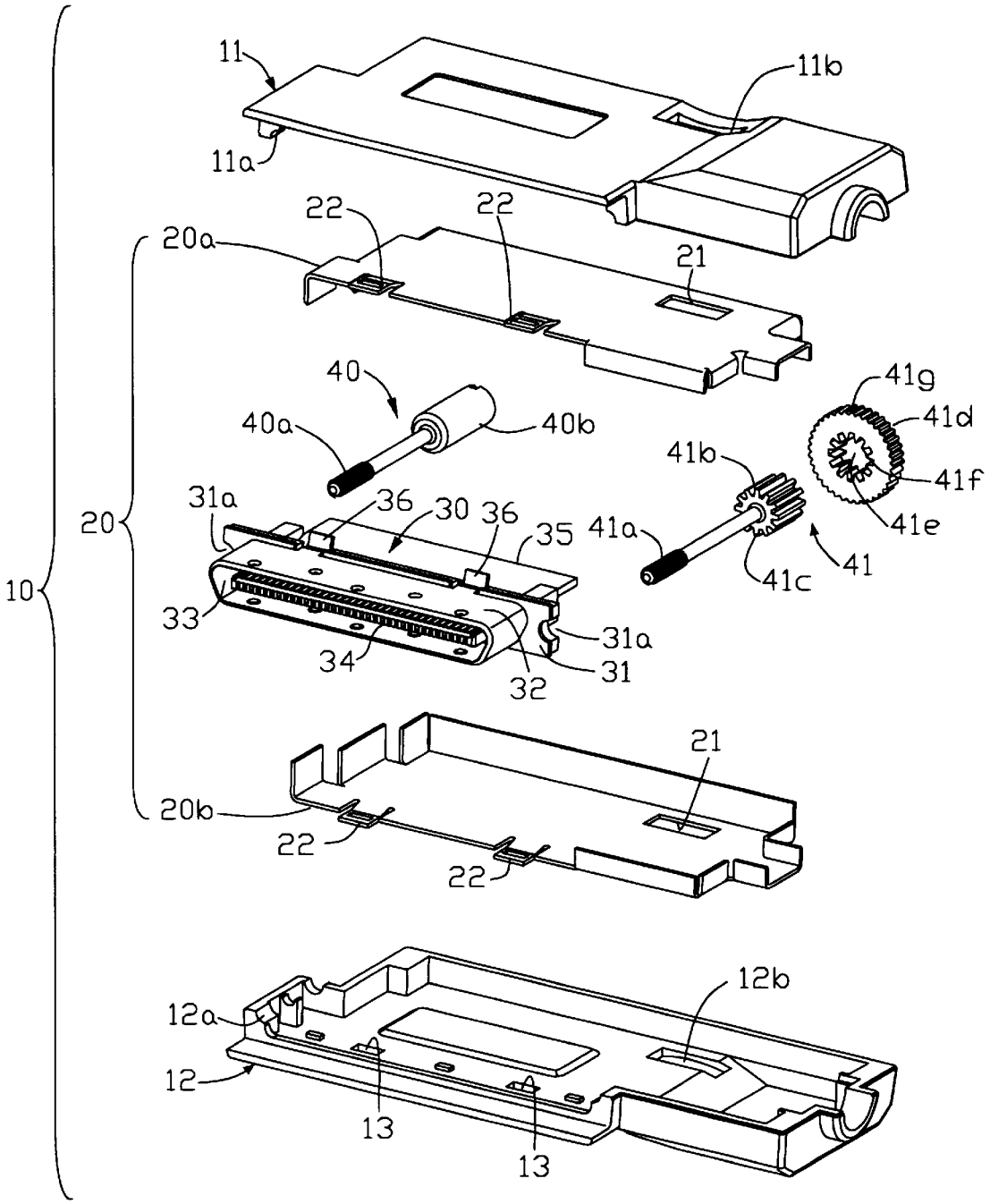
FIG. 2 is an exploded view of a cable assembly in accordance with the present invention.
Figure 3:
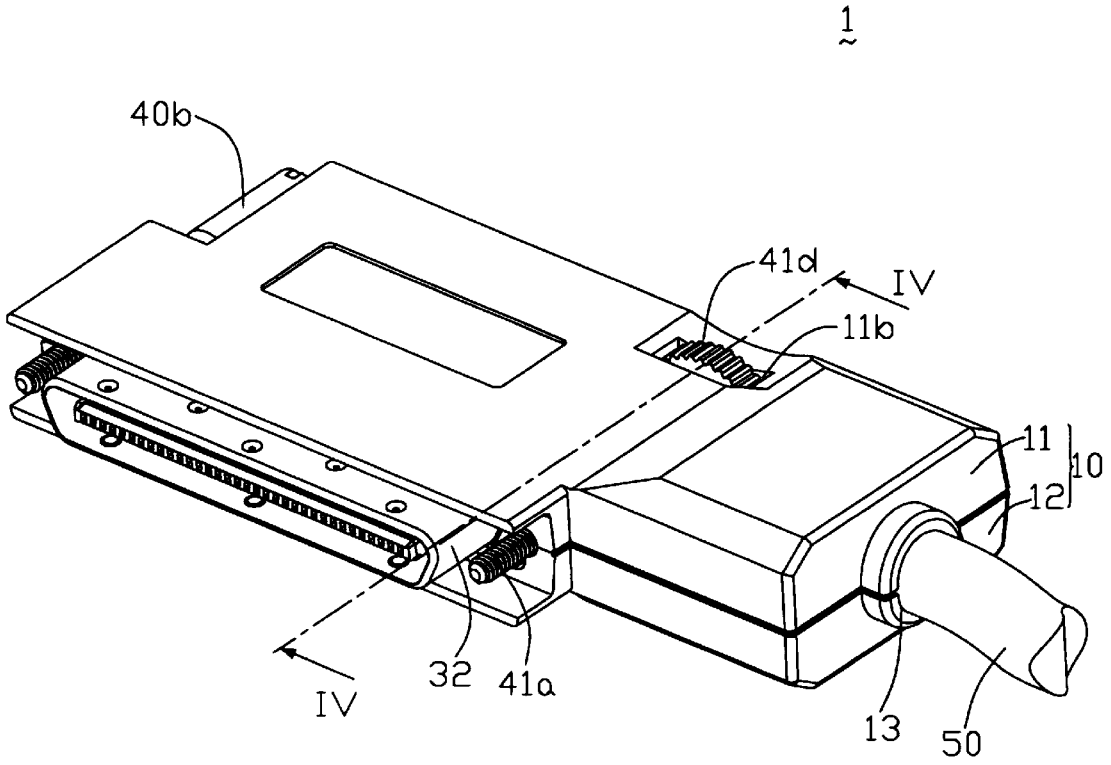
FIG. 3 is an assembled view of the cable assembly in accordance with the present invention.

Referring to FIG. 2, a cable assembly 1 in accordance with the present invention comprises a casing 10, an EMI shield 20, and a connector 30. The casing 10 is configured by an upper half 11 and a lower half 12, jointly defining a receiving space therebetween. The EMI shield 20 includes an upper part 20*a* and a lower part 20*b* each defining an aperture 21. The connector 30 is received within the receiving space and is enclosed by the EMI shield 20. The upper half 11 defines a semi-circular recess 11 a at an end thereof. The lower half 12 also defines a semi-circular recess 12*a* corresponding to the recess 11*a* and jointly defining a channel (not labeled). The upper and lower halves 11, 12 each defines a slot 11*b*, 12*b* therein. Each half 11, 12 further includes an opening 11*c*, 12*c* jointly defining an outlet 13 for the cable 50 (FIG. 3).

The connector 30 includes a housing 31 having a mating portion 32 extending from the housing 31. The mating portion 32 defines a cavity 33 in which a plurality of terminals 34 are arranged. A PCB 35 is connected to the terminals 34 and has connecting pads (not shown) formed thereon for electrically connecting with conductors (not shown) of the cable 50. The housing 31 defines a cutout 31*a* which is aligned with the channel defined by the recesses 11*a*, 12*a*.

A first bolt member 40 includes a threaded portion 40*a* which is rotationally inserted into the channel defined by the recesses 11*a*, 12*a*. The first bolt member 40 includes a head portion 40*b* for maneuvering the lock or unlock of the first bolt member 40. The threaded portion 40*a* extends through the cutout 31*a*.

A second bolt member 41 opposite the first bolt member 40 is assembled in the casing 10. The second bolt member 41 includes a threaded portion 41*a* extending through the cutout 31*a*. The second bolt member 41 includes a head 41*b* defining a plurality of slots 41*c* therein. The second bolt member 41 further includes an adjusting wheel 41*d* defining an opening 41*e* therein. The opening 41*e* forms a plurality of teeth 41*f* along the inner rim for engagement with the slots 41*c*. The outer rim of the adjusting wheel 41*d* extends through the slots 11*b*, 12*b*. By this arrangement, a user may maneuver the lock or unlock of the second bolt member 41.

Figure 5:
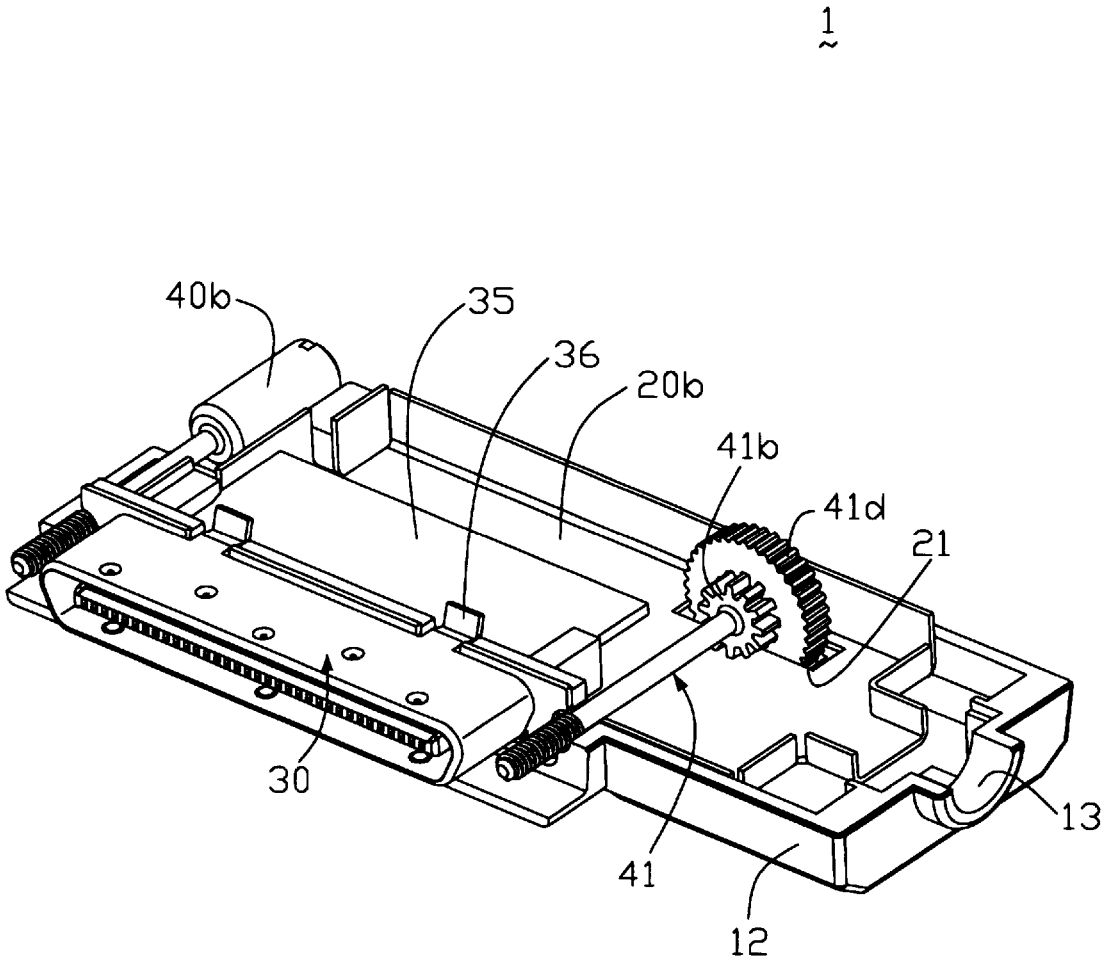
FIG. 5 is a perspective view of a partially assembled cable assembly of FIG. 2.

Referring to FIGS. 2, 3 and 5, when the connector 30 and the EMI shield 20 are assembled to the casing 10, the retaining tags 36 on the top and the bottom of the connector 30 can extend through the openings of the corresponding fastening tags 22 of the shield 20 and into the corresponding recesses 13 of the casing 10. At the same time, the head 40*b* of the first bolt member 40 is located outside of the casing 10, and the adjusting wheel 41*d* extends through the aperture 21 of the shield 20 and the slot 11*b* of casing 10. By this arrangement, when the mating portion 32 is electrically engaged with a complementary connector (not shown), the first bolt member 40 can be locked by maneuvering the head 40*b*, and the second bolt member 41 can be locked by maneuvering the adjusting wheel 41*d*. By this arrangement, the overall front-to-back dimension of the cable assembly 1 is reduced.

Figure 4:
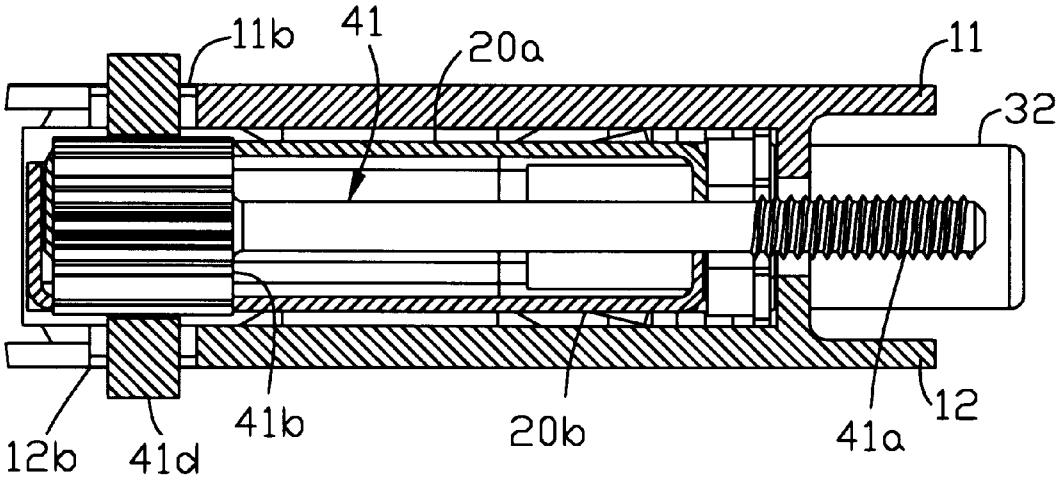
FIG. 4 is a cross sectional view taken along line IV—IV of FIG. 3.

FIG. 4 is a cross sectional view showing the engagement between the adjusting wheel 41*d* and the head 41*b*. Since the teeth 41*f* are snugly received in the corresponding slots 41*c*, axial movement of the second bolt member 41 completes the engagement of the threaded portion 41*a*.

Generally speaking, it is not easy for the conventional cable assembly to have the cable outlet extending in a lateral direction with regard to the connector. Under that situation, the casing can not but extend laterally, thus resulting in covering/enclosing the head of the adjacent bolt member and hindering the user from operating that bolt member, unless the head of that bolt member extends longer out of the outermost rear face/edge of the casing to an exterior for easy access from the outside. While, this alternation will lengthen the front-to-back dimension of the whole assembly that jeopardizes the object of the invention. Therefore, the invention intentionally forms the slot 12*b* and provides an enlarged adjusting wheel 41*d* which can extend out of the slot 12*b* and easy to be accessibly operated from the exterior, without necessity of lengthening the bolt member for exposing the head thereof along the front-to-back direction. Therefore, the whole right angle type cable connector assembly can be efficiently controllably maintained with a desired minimum dimension in the front-to-back direction.

While the present invention has been described with reference to a specific embodiment, the description is illustrative of the invention and is not to be construed as limiting the invention. Various modifications to the present invention can be made to the preferred embodiment by those skilled in the art without departing from the true spirit and scope of the invention as defined by the appended claims.

I claim:

1. A wire harness cable assembly, comprising:

an outer casing defining a receiving space therein, said casing defining a first opening in a side thereof in communication with the receiving space, said casing defining a second a second opening in an end thereof perpendicular to said first opening;

a connector assembled in said casing, said connector having a mating portion protruding from said first opening for electrical engagement with a complimentary connector;

a cable electrically connected to a connecting end of said connector at one end, and another end of said cable extending through said second opening;

a first bolt member extending through a channel defined in an end of said casing, having a head located outside of said casing and a threaded portion extending beyond a front face of said connector; and a second bolt member opposite said first bolt member assembled within said casing, including an adjusting wheel extending beyond an upper face of said casing through a slot and a threaded portion extending beyond said front face of said connector.

2. The wire harness cable assembly as recited in claim 1, wherein said connector and cable are enclosed by an EMI shield.

3. The wire harness cable assembly as recited in claim 1, wherein said casing is configured by upper and lower halves.

4. The wire harness cable assembly as recited in claim 1, wherein said upper face of said casing defines said slot for extension of said adjusting wheel.

5. A cable connector assembly, comprising:

an outer casing defining a receiving space therein and at least one slot defined in an upper face thereof and being communicative with both said receiving space and an exterior in a vertical direction, said casing further defining a cable outlet in a lateral direction perpendicular to said vertical direction;

a connector being attached to said casing in a front-to-back direction perpendicular to both said vertical direction and said lateral direction; and two bolt members extending by two sides of the connector and attached to the casing wherein one of said bolt members has a head fully positioned outside the casing, and the other of said bolt members has an adjusting wheel which is vertically accessible through the slot for easy operation from the exterior.

6. The cable connector assembly as recited in claim 5, wherein at least one shield is provided between the casing and said other bolt members and defines an aperture for allowing the adjusting wheel to extend therethrough.

7. A right angle type cable connector assembly comprising:

an outer casing defining a receiving space therein, a first opening in a side thereof in communication with said receiving space, and a second opening in an end thereof perpendicular to said first opening;

a connector assembled to the casing around said first opening;

a cable electrically connecting to said connector at one end and extending our of said second opening; and at least one bolt member extending in a front-to-back direction and positioned by one side of the connector and between said connector and said second opening; wherein said bolt member includes an adjusting wheel which does not extend beyond the outermost rear face of the casing while being exposed to an exterior through a cutout of said casing for easy access.

* * * * *